United States Patent [19]

Ripoll Garcia-Mansilla

[11] Patent Number: 4,619,088

[45] Date of Patent: Oct. 28, 1986

[54] STRESSED REINFORCING TENDON AND STRUCTURE INCLUDING SUCH A TENDON

[75] Inventor: Javier Ripoll Garcia-Mansilla, Madrid, Spain

[73] Assignee: Manufacturas De Acero Y Caucho S.A., Barcelona, Spain

[21] Appl. No.: 713,604

[22] Filed: Mar. 19, 1985

[30] Foreign Application Priority Data

Mar. 23, 1984 [GB] United Kingdom ..... 8407596

[51] Int. Cl.[4] ..... E04C 3/10

[52] U.S. Cl. ..... 52/223 L; 52/230

[58] Field of Search ..... 52/223 L, 230; 24/115 M, 122.6, 136 R

[56] References Cited

U.S. PATENT DOCUMENTS

| | | | |
|---|---|---|---|
| 2,341,922 | 2/1944 | King et al. | 52/223 L X |
| 3,422,501 | 1/1969 | Yoshimura | 52/230 X |
| 4,442,646 | 4/1984 | Prevedini . | |

FOREIGN PATENT DOCUMENTS

| | | |
|---|---|---|
| 880224 | 10/1961 | United Kingdom . |
| 961006 | 6/1964 | United Kingdom . |
| 1149484 | 4/1969 | United Kingdom . |
| 1237149 | 6/1971 | United Kingdom . |
| 1391485 | 4/1975 | United Kingdom . |
| 2140480A | 11/1984 | United Kingdom . |

*Primary Examiner*—Carl D. Friedman

*Attorney, Agent, or Firm*—Larson and Taylor

[57] ABSTRACT

A stressed reinforcing tendon for a structure has at least one stressed elongate element and an anchoring body in said structure to which said element is anchored by means of an anchoring device e.g. a wedge, button head or nut engaging the element so as to transmit stress in the element to the anchoring body. To overcome a potential weakness at the connection of the element to the anchoring device, there is a secondary load transfer element secured to the stressed element at a stressed portion thereof and secured to the anchoring body to relieve the said anchoring device of part of the stress being transferred to the anchoring body. The secondary element may be a tube secured to the stressed element by cementing material.

8 Claims, 8 Drawing Figures

STRESSED REINFORCING TENDON AND STRUCTURE INCLUDING SUCH A TENDON

BACKGROUND OF THE INVENTION

1. Field of the Invention

This invention relates to stressed reinforcing tendons for structures, for example concrete structures and structures having stays constituted by stressed tendons. The invention also relates to such a structure including a stressed reinforcing tendon.

2. Description of the Prior Art

A reinforcing tendon, e.g. in prestressed concrete, consists of at least one stressed element e.g. steel strand wire or bar. By strand we mean an element composed of a plurality of individual wires (usually 7 or 19, with one of the wires providing a central core around which the others are wound helically). At the so-called live end of the tendon, these stressed elements are anchored in an anchoring body, usually a plate, after being stressed by a jack applied at the live end. Various devices are used to anchor the elements, examples being (a) frusto-conical split wedges surround the element and lodged in frusto-conical bores in the anchoring plate, (b) so-called button heads which are swaged or otherwise fixed onto the end of the element projecting through the anchoring plate and (c) in the case of bar, a nut engaging a screwthread on the bar.

Reference is made to GB-A-2,095,302 to give an example of an anchorage for a stressed tendon.

SUMMARY OF THE INVENTION

The present inventor has come to the realisation that the weakest point in the tendon is the connection of the stressed element to the device anchoring it to the anchoring member. This particularly applies when the tendon is subject to cyclic loading (as for example in the case of the cable stay for a bridge). In tests involving repeated cyclic loading, and in ultimate strength tests, the element tends to fracture at its connection to the anchoring device. It is the object of this invention at least partly to remove this weakness.

According to the present invention there is provided a stressed reinforing tendon for a structure comprising at least one stressed elongate element, an anchoring body in said structure to which said element is anchored by means of an anchoring device engaging the element so as to transmit the stress in the element to the anchoring body, and a secondary load transfer element secured to the stressed element at a stressed portion thereof and secured to the anchoring body so as to relieve the said anchoring device of part of the stress being transferred to the anchoring body.

The principle of the invention, namely to provide a secondary element which transmits some of the load from the stressed element to the anchoring body, is applicable to any of the existing kinds of anchoring devices, i.e. split wedges, button heads and nuts.

A preferred form of secondary element is a tube surrounding the stressed element and extending away from the anchoring body. This tube can be adhered to the stressed element by adhesive, e.g. epoxy cement, injected into it after the tensioning of the element. One end of the tube is secured to the anchoring body, so that the tube transmits load from the stressed element to the anchoring body. This arrangement is particularly suitable when split frusto-conical wedges are used, if the end of the sleeve is frusto-conical and is trapped between the conical surfaces of the wedge and the corresponding conical surface of the bores in the anchoring body in which the wedge is lodged.

In one form of the invention, the load transfer element transmits to the anchoring body the whole of the load applied by the stressed element to the anchoring device while itself transmitting part of the tension load of the stressed element to the anchoring body. An example of this arrangement is a button-head on the stressed strand which bears on a split frusto-conical wedge which is located in a conical bore in the anchoring body and is itself gripping the strand. In this case the frusto-conical wedge is the load-transfer element.

The invention is applicable to unfilled or filled anchorages. A filled anchorage may be filled with soft material, allowing exchange of a stressed element during the life of the tendon.

BRIEF INTRODUCTION OF THE DRAWINGS

Embodiments of this invention will now be described by way of example with reference to the accompanying drawings, in which.

DESCRIPTION OF THE PREFERRED EMBODIMENTS

Figure 1:
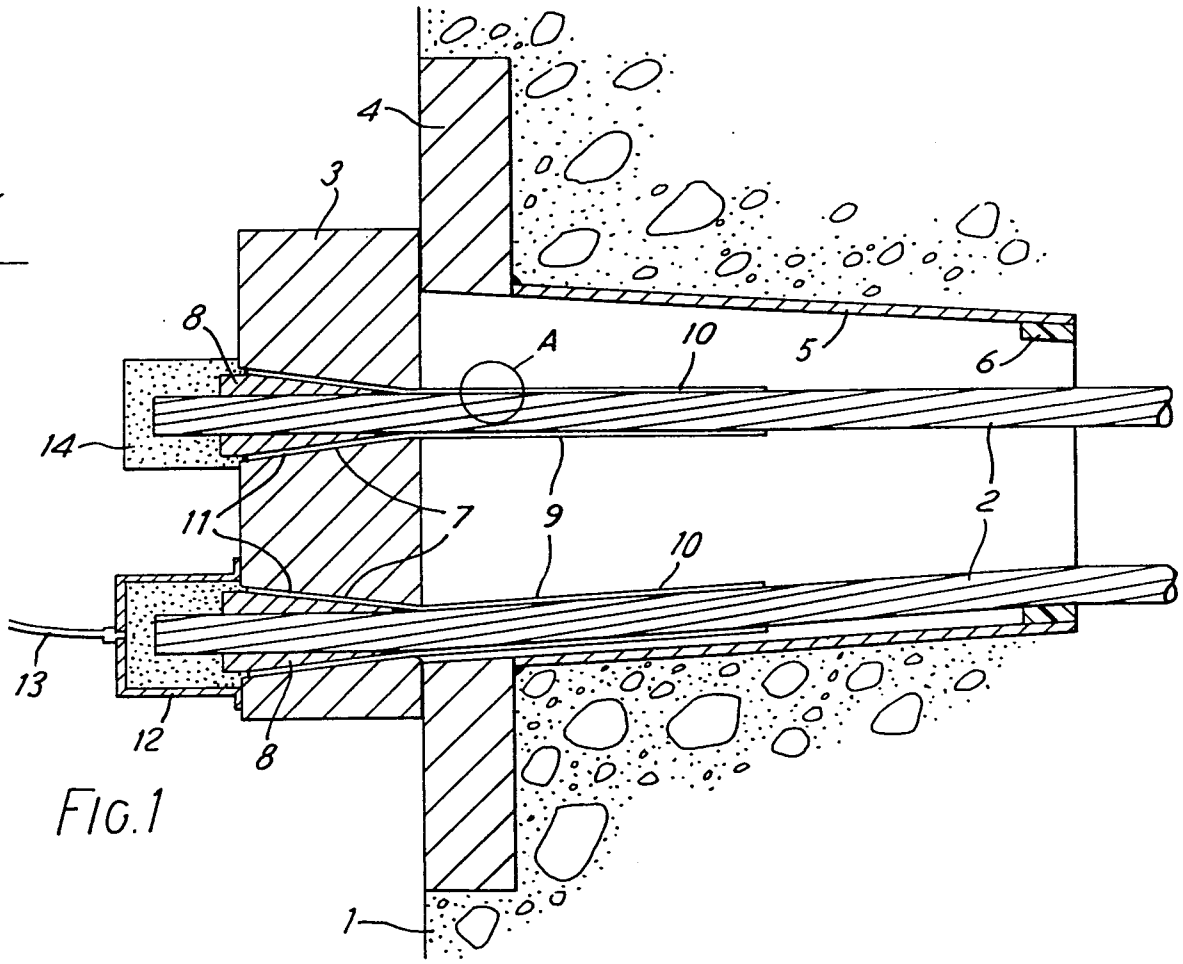
FIG. 1 is a simplified axial sectional view of an anchorage embodying the invention in a prestressed concrete structure.

Shown in FIG. 1 is a concrete structure 1 having a prestressed reinforcing tendon constituted by a plurality of stressed steel strands 2, in conventional manner. Only two strands 2 are shown, for clarity, but in practice there will be a larger number of such strands. The strands 2 are anchored, as will be described in more detail later, in an anchoring body in the form of a plate 3 which bears on a ring 4 embedded in the concrete structure 1. The ring 4 has a frusto-conical sleeve 5 welded to it and extending into the concrete structure to define one end of the aperture through the structure in which the strands 2 extend. A plastics ring 6 keeps the strands 2 spaced from the sleeve 5.

After tensioning of the strands 2, the anchorage may be filled, e.g. the sleeve 5 is filled with a soft material such as grease. Use of a soft material allows strands to be removed and replaced later.

The plate 3 has frusto-conical bores 7 which receive split frusto-conical wedges 8 having central bores and gripping the strands 2. This is conventional. The main feature of the invention is the steel tubes 9 which form secondary means, in addition to the wedges 8, for attaching the strands 2 to the anchoring plate 3 so as to transmit part of the tension load in the strands to the plate and thus to the concrete structure. Each tube 9 is threaded on the strands 2 before tensioning, and has a cylindrical portion 10 which closely surrounds the length of the tensioned strand extending away from the plate 3 and a flaring portion 11 which is preshaped so as to lie against the walls of the bore 7 in the plate 3. As shown in the drawing the wedges 8 are thus inserted into the portions 11 of the tubes 9 and do not directly contact the plate 3. Instead the wedges 8 clamp the tubes 9 in the bores 7 in the plate.

After tensioning of the strands 2, e.g. by means of a jack applied against the plate 3, a mould 12 is placed temporarily around the exposed end of the strand 2 (which has been cut short as necessary) and the exposed end of the wedge 8, and a suitable cementing material is injected under pressure through the pipe 13. This cement fills the mould 12 and passes through the wedge (via the gaps between the split portions of the wedge) and along within the cylindrical portion 10 of the tubes 9 until it emerges at the other end of the tubes 9. By this time sufficient cement has been injected. The cement is then allowed to set so that the tube 9 is securely fixed to the strand 2 and is thus able to transfer load from the strand to the plate 3. Any suitable cement, e.g. an epoxy cement, can be employed. The mould is subsequently removed leaving a cement cap 14 over the end of the strand and the wedge, as indicated for the upper strand in FIG. 1.

By reducing the load applied by the stressed element 2 to the anchoring wedge 8, the load transfer tube 9 improves the anchorage because weakness at the connection of the element 2 to the wedge 8 is less of a problem. Another advantage in the embodiment of FIG. 1 is that the injected cement and the tube 9 prevent access of water from within the anchorage to the wedge 8 and the part of the strand 2 lying in the anchoring plate. Water tends to penetrate into the anchorage if the plate 3 moves, e.g. due to cyclic loading.

Figure 2:
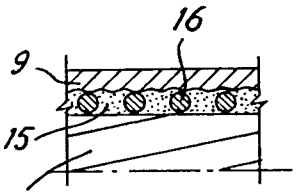
FIG. 2 is an enlarged view of the portion A of FIG. 1.

The tube 9 is substantially rigid, and can have an internal diameter such that it generally contacts the exterior surface of the strand, but since the strand surface is not a smooth cylinder (because it is formed of helically wound wires), passages are left between the strand and the tube for the movement of the cement along the strand. Alternatively, as shown in FIG. 2, the tube can have an internal diameter somewhat larger than the diameter of the strand, so as to leave a gap for the formation of a cement body 15 lining the strand and the tube. To provide centering of the tube with respect of the strand, this gap may contain a spiral wire 16, made e.g. of plastics, as shown in FIG. 2. Alternatively the tube which has a larger internal diameter than the strand, can be crimped against the strand, so as to provide indentations in its inner surface which hold it in the appropriate position while nevertheless leaving a continuous passage for the movement of the cement. Another possibility is to provide suitably spaced corrugations on the inner surface of the tube, which contact the strand to maintain the desired position of the tube. Even if, as shown in FIG. 2, the inner surface of the tube does not contact the strand, it is suitably provided with roughnesses or corrugations as shown, so that a good grip of the cement is achieved.

As mentioned above, the principle of the invention, in particular the tube threaded on the strand as shown in the drawing, is applicable to other methods of anchoring the tensioned strands in the anchoring plate, for example button heads or nuts. In such cases, what is essential is that the tubes are themselves suitably anchored to the anchoring plate so as to transfer part of the tension load in the strands from the main anchoring element (i.e. the button head or the nut).

Figure 3:
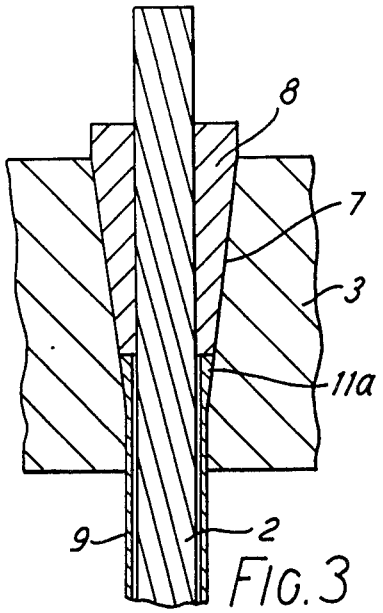
FIGS. 3 to 5 are sectional views showing other forms of load transfer elements and how they are connected to the anchoring body and the stressed element.
Figure 4:
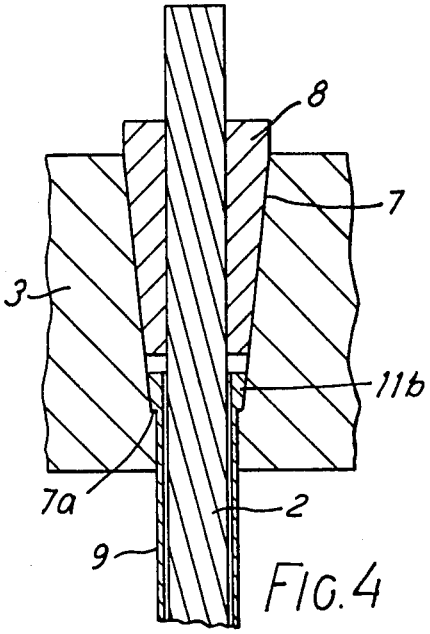
Figure 5:
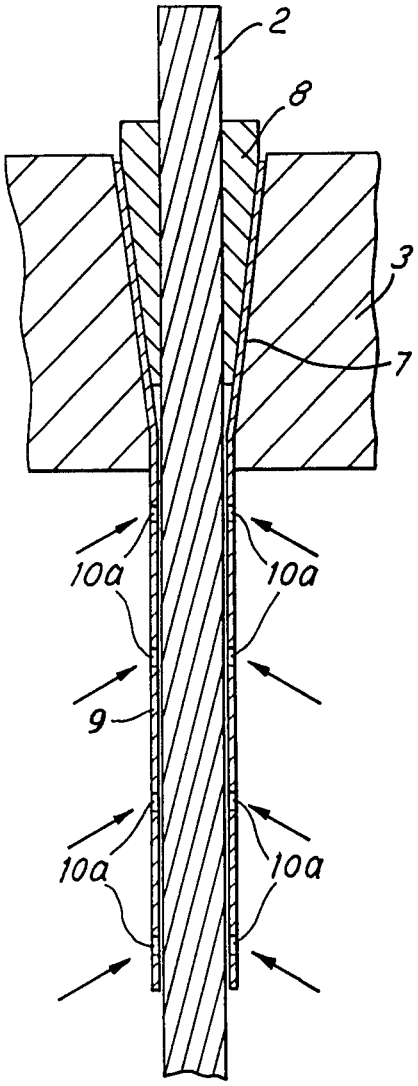

FIGS. 3 to 5 show alternative arrangements in which the load transfer tube is cemented to the strand. These figures for convenience show only the strand 2, part of the anchoring plate 3 with its conical bore 7, the split conical wedge 8 and the load transfer tube 9.

In FIG. 3 the tube 9 is shown with a thickened portion 11*a* at its end within the bore 7, this portion having a frusto-conical outer surface which engages the wall of the bore 7 to hold the tube 9 in place. The tube 9 is not trapped between the wedge 8 and the anchoring plate 3. This is also the case in FIG. 4 where the bore 7 has a shoulder 7*a* at its narrow end and the tube 9 has an enlarged end 11*b* abutting the shoulder 7*a*.

In FIGS. 3 and 4, the method of cementing the tube 9 to the strand 2 is as in FIG. 1, but in FIG. 5, the cement is injected as indicated by arrows through holes 10*a* directly to the desired location along the length of tube extending away from the anchoring plate. The tube 9 is here otherwise the same as in FIG. 1.

Figure 6:
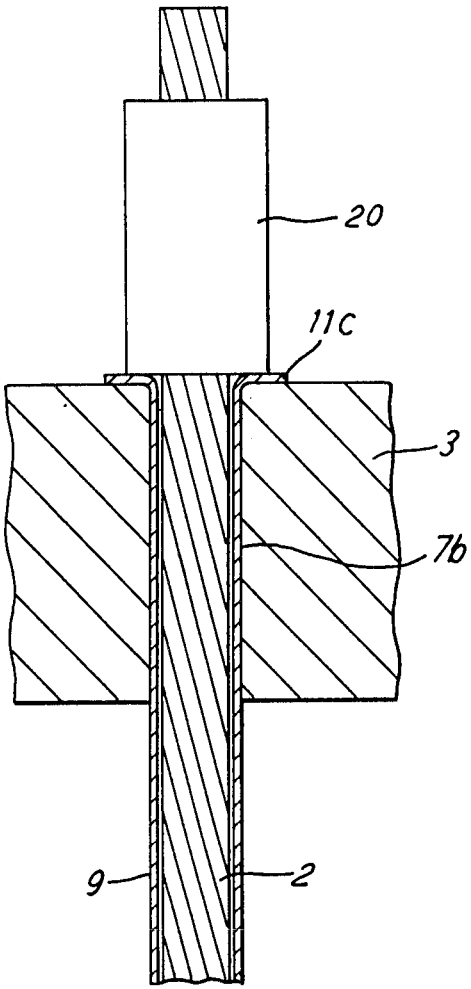
FIGS. 6 and 7 show in axial section respectively two embodiments in which button-heads are swaged onto the stressed element and a transfer element transmits load to the anchoring body, FIG. *7a* showing the transfer element of FIG. 7 in perspective.
Figure 7A:
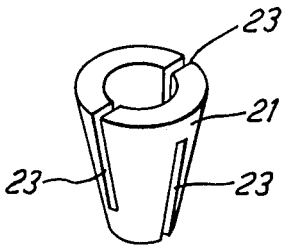
Figure 7:
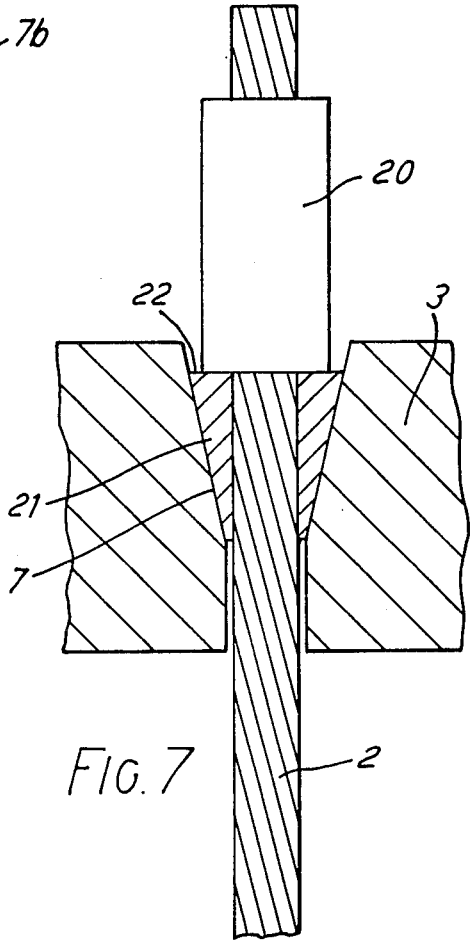

In FIGS. 6 and 7, the stressed strand 2 is shown with its end engaged by a compression grip or nut 20, known as a button head, which is swaged onto the strand to grip it firmly. The bore 7*b* in the anchoring plate 3 is shown in FIG. 6 as cylindrical and the tube 9 extends through it to the exterior side of the plate 3 where it has a flange 11*c* which is trapped between the button head 20 and the plate 3. The tube 9 is cemented to the strand 2 in the same way as in FIG. 1 or FIG. 5, a passage for the cement being provided if necessary in the grip 20 or the plate 3.

FIG. 7 shows an embodiment where the button head 20 bears on the large end 22 of the split frusto-conical wedge which here is in the form of a transfer cone 21 shown in perspective in FIG. 7A. This cone 21 is lodged in the conical bore 7 of the plate 3 and has axial slits 23, two at each end located diametrically opposite each other and extending axially to overlap those of the opposite end. The cone 21 is thus radially compressible so as to grip the strand 2 and transmit part of the tension load of the strand directly to the plate 3 while also transferring to the plate 3 all the load applied to the button head 20 by the strand 2. The cone 21 has the advantage of being in one piece, but must be threaded onto the end of the strand. Alternatively a conventional split wedge may be used, this being fully divided into separate pieces.

What is claimed is:

1. A stressed reinforcing tendon for a structure comprising at least one elongate element stressed over at least a portion of its length, an anchoring body in the form of a plate engaging said structure to transmit load thereto, a primary load transfer element in the form of an anchoring device anchoring said elongate element to said anchoring body by engaging the elongate element at one end of said stressed portion thereof so as to transmit stress in the elongate element from the elongate element to the anchoring body, and a second load transfer element in the form of a tube surrounding the stressed elongate element, said tube being secured at one end to the anchoring body and extending away from the anchoring body along said stressed portion of the eleongate element and being secured to the stressed portion of the elongate element at least at a region spaced from the anchoring body such that the tube transfers to the anchoring body part of the stress in the stressed elongate element thereby relieving the primary load transfer element of part of the stress in the stressed elongate element.

2. A tendon according to claim 1 wherein the anchoring device is one of a split frusto-conical wedge, a button head and a nut.

3. A tendon according to claim 1 wherein the tube which is secured to the stressed element by cementing material injected into the tube.

4. A tendon according to claim 1 wherein the anchoring device is a split frustoconical wedge and the said one end of the tube is clamped between the wedge and the anchoring body so as to transmit load to the body.

5. A tendon according to claim 1 wherein the said one end of the tube is of enlarged shape so as to be trapped within a narrowing bore of the anchoring body so as to transmit load to the body.

6. A tendon according to claim 1, wherein the secondary load transfer element transmits to the anchoring body the whole of the load applied by the stressed element to the primary load transfer element while itself transmitting part of the load of the stressed element to the anchoring body.

7. A stressed reinforcing tendon for a structure comprising at least one stressed elongate element, an anchoring body engaging said structure and having a conical bore receiving said elongate element, a first load transfer element in the form of a button head anchored to said elongate element and a second load transfer element in the form of a split frustoconical wedge located in said conical bore and gripping the stressed element, said button head bearing on said wedge such that the wedge transfers load from the button head to the anchoring body and thus that the button head transfers part of the load of the stressed element by means of the wedge to the anchoring body and the wedge transfers another part of the load of the stressed element to the anchoring body, the wedge thereby relieving the button head of part of the load in the stressed element.

8. A stressed reinforcing tendon for a structure comprising at least one elongate element stressed over at least a portion of its length, an anchoring body in the form of a plate engaging said structure to transmit load thereto, a primary load transfer element in the form of an anchoring device anchoring said elongate element to said anchoring body by engaging the elongate element at one end of said stressed portion thereof and cooperating with the anchoring body so as to transmit stress in the elongate element to the anchoring body, and a secondary load transfer means for transferring part of the stress in the elongate element to the anchoring body, said secondary load transfer means being secured to the anchoring body and being secured to the stressed portion of the elongate element in such a manner as to transfer to the anchoring body part of the stress in the elongate element to thereby releave the primary load transfer element of part of the stress in the elongate element.

* * * * *